US005147475A

United States Patent [19]

Holmberg

[11] Patent Number: 5,147,475

[45] Date of Patent: Sep. 15, 1992

[54] HIGH STRENGTH STAINLESS STEEL

[75] Inventor: Håkan Holmberg, Gävle, Sweden

[73] Assignee: Sandvik AB, Sandviken, Sweden

[21] Appl. No.: 661,000

[22] Filed: Feb. 26, 1991

[30] Foreign Application Priority Data

Feb. 26, 1990 [SE] Sweden ..... 9000675

[51] Int. Cl.[5] ..... C22C 38/18; C22C 38/34; C22C 38/40

[52] U.S. Cl. ..... 148/327; 420/43; 420/44; 420/50; 420/97; 420/98; 420/117

[58] Field of Search ..... 420/34, 44, 50, 59, 420/65, 97, 98, 117, 584.1, 45; 148/325, 327

[56] References Cited

U.S. PATENT DOCUMENTS

| | | | |
|---|---|---|---|
| 3,726,668 | 4/1973 | Bäumel et al. | 420/45 |
| 3,825,417 | 7/1974 | Costello et al. | 420/584.1 |
| 3,912,503 | 10/1975 | Schumacher et al. | 75/125 |
| 4,337,088 | 6/1988 | Moses, Jr. | 72/128 A |

FOREIGN PATENT DOCUMENTS

| | | |
|---|---|---|
| 1572641 | 6/1969 | France . |
| 177080 | 2/1966 | U.S.S.R. . |

OTHER PUBLICATIONS

Holmberg, Håkan, ISIJ Int. 30(8), 594–9, Aug. 1990, Chemical Reg. #130141-51-4.

*Primary Examiner*—R. Dean
*Assistant Examiner*—Sikyin Ip
*Attorney, Agent, or Firm*—Burns, Doane, Swecker & Mathis

[57] ABSTRACT

The invention relates to a high silicon containing stainless steel alloy in which the amounts of the alloy elements have been balanced such that the austenite phase remains stable without being deformed into martensite even under large amounts of working. The steel alloy comprises 0.04–0.25% C, 2.0–5.0% Si, 3.5–7.5% Mn, 16–21% Cr, 8–11% Ni, 0.10–0.45% N, the remainder being iron and normal impurities.

8 Claims, No Drawings

HIGH STRENGTH STAINLESS STEEL

BACKGROUND OF THE INVENTION

The invention relates to a high strength, precipitation hardening, non-magnetic austenitic stainless steel alloy in which the austenite phase is sufficiently stable so that it does not transform to the ferromagnetic martensite phase even under substantial reduction, for instance by cold rolling of sheet or drawing of wire made from the alloy.

The rapid development within the computer and electronics industry has created an increased demand for materials with combinations of properties not previously considered or easily achievable such as, for example, the combination of high mechanical strength and a non-magnetic structure for materials to be used in spring applications where the material is required to be magnetically inert. For many of these products, the manufacture involves various forming (reducing) steps. Since it is common knowledge that increased strength also leads to impaired ductility, it is an essential advantage if the forming steps can be carried out in as soft condition as possible and the required strength ultimately needed can be achieved by a simple heat treatment.

Among these high strength stainless steels, the so-called non-stable austenitic spring steels, SS 2331 with a typical nominal analysis of 17 Cr, 7 Ni, 0.8 Si, 1.2 Mn, 0.1 C and 0.03 N are in a special position because of their combination of high strength and good corrosion properties.

The very high strength achievable with this type of steel depends from the fact that the (non-magnetic) austenitic structure is transformed during deformation to (ferromagnetic) martensite, a phase that has exceptional hardness. When the amount of alloying elements (primarily Ni and Mo) is increased as in such types SS 2343/2353, the tendency for the formation of deformation martensite is reduced but the possibility of achieving high strength is thereby also reduced. Furthermore, the use of this type of steel leads to high alloying costs because the high amounts of nickel and molybdenum.

SUMMARY OF THE INVENTION

Thanks to a systematic development work it has now been found that it is possible, by a carefully selected composition to achieve, by cold working, a specific deformation hardening effect while preserving a non-magnetic structure. In addition, it has been found possible, without affecting the magnetic properties, to provide precipitation hardening of the alloy to a very high strength by carrying out a simple heat treatment.

The strictly controlled optimized composition (in weight-%) of the alloy of the present invention in its broadest aspect is as follows:

C: 0.04–0.25
Si: 2.0–5.0
Mn: 3.5–7.5
Cr: 16–21
Ni: 8–11
N: 0.10–0.45 the remainder being Fe and normal impurities.

DETAILED DESCRIPTION OF THE PREFERRED EMBODIMENTS OF THE INVENTION

The amounts of the various components, which are very critical, are governed by the demand for the structure which should be single phase austenite showing no presence of ferrite. The austenite phase shall be sufficiently stable so that it is not, to any significant degree, transformed into ferromagnetic martensite during cooling from high temperature annealing or at substantial cold working. Typically, the austenite should maintain its stability during cold working of above 70% thickness reduction during cold working or a corresponding degree of reduction by wire drawing. At the same time, the austenite phase shall exhibit a substantial cold hardening during deformation which means that high mechanical strength can be achieved without the presence of a ferromagnetic phase. It is also important to achieve, in the cold worked condition, a further increase in strength by carrying out a simple heat treatment.

In order to achieve these objectives simultaneously, the effects of the alloying constituents must be known. Certain of these constituents are ferrite formers whereas others are austenite formers at those temperatures that are relevant to hot working and annealing. Additionally, certain of these constituents will increase the deformation hardening during cold working whereas others decrease the same.

The reason for limiting the composition of the steel of the present invention is explained hereunder wherein all amounts are given in terms of weight-%.

Carbon is an element which strongly contributes to austenite formation. Carbon also contributes to a stabilization of the austenite against martensite transformation and it has consequently a double positive effect in this alloy. Carbon also positively contributes to work hardenability during cold working. The carbon content should therefore exceed 0.04%. High carbon amounts, however, leads to negative effects. Its high chromium affinity results in an increased tendency for carbide precipitation with increased carbon content. This also leads to impaired corrosion properties, embrittlement problems, and a destabilization of the matrix which might lead to local martensite transformation which renders the material being partially ferromagnetic. The maximum content of C is limited to 0.25% preferably below 0.15%.

Si is an important element for the purpose of facilitating the manufacturing process. In addition, Si has been found to have a precipitation hardening effect by contributing to the precipitation of $\gamma$-phase during heat treatment. The Si content should therefore be at least 2%. Si is, however, a ferrite stabilizer which rather drastically tends to increase the tendency for the formation of the ferromagnetic phase of ferrite. High Si amounts additionally promote the tendency to precipitate easily melting intermetallic phases and thereby impairs the hot working. The Si-content should therefore be limited to max 5%, preferably 3.0–5.0%.

Manganese has been found to contribute positively to several properties of the alloy of this invention. Mn stabilizes austenite without simultaneously negatively affecting the work hardening. Mn has the additional important ability of providing solubility of nitrogen, properties described more specifically hereunder, both in the melted and solid phases. The Mn content should therefore exceed 3.5%. Mn increases the coefficient of linear expansion and reduces electrical conductivity which could be of disadvantage for applications within electronics and computer areas. High amounts of Mn also reduce corrosion resistance in chloride containing environments. Mn is also much less efficient than nickel as a corrosion reducing element under oxidizing corrosion conditions. The Mn content should therefore not exceed 7.5%, and should preferably amount to 3.5-5.5%.

Cr is an important alloy element from several aspects. Cr content should be high in order to achieve good corrosion resistance. Cr also increases the nitrogen solubility both in the melt and in the solid phase and thereby enables the increased presence of nitrogen in the alloy. Increased Cr content also contributes to stabilizing the austenite phase against martensite transformation. The alloy of the present invention can, to advantage as described below, be annealed and precipitate high chromium containing nitrides. In order to reduce the tendency for excessive local reduction of Cr-content with the concomitant non-stabilization of the austenite phase and reduction in corrosion resistance, the Cr content should exceed 16%.

Since Cr is a ferrite stabilizing element, the presence of very high Cr contents will lead to the presence of ferromagnetic ferrite. The Cr content should therefore be less than 21%, preferably less than 19%.

Ni is, next after carbon and nitrogen, the most efficient austenite stabilizing element. Ni also increases austenite stability against deformation into martensite. Ni is also, in contrast to Mn, known for efficiently contributing to corrosion resistance under oxidizing conditions. Ni is, however, an expensive alloying element and at the same time has a negative impact on work hardening during cold working. In order to achieve a sufficiently stable non-magnetic structure, the Ni-content should exceed 8%. In order to achieve high strength after cold working the Ni-content should not exceed 11%, and preferably not exceed 10%.

N is a central alloy element in the present alloy. N is a strong austenite former, promotes solution hardening and stabilizes the austenite phase strongly against deformation into martensite. N is also advantageous for achieving increased work hardening during cold working and acts as a precipitation hardening element during heat treatment. Nitrogen can therefore contribute to a further increase of cold rolled strength. Nitrogen also increases the resistance of the alloy to nodular corrosion. Chromium nitrides precipitated during heat treatment also appear to be less sensibilizing than corresponding chromium carbides. In order to completely take advantage of its many good properties, the N content should not be less than 0.10%, preferably not less than 0.15%.

When using very high nitrogen contents, the solubility of N is exceeded in the melt. The N content should therefore not exceed its solubility in the alloy melt and be equal to or less than 0.45%, and preferably amount to 0.20-0.45%.

The invention will in the following be disclosed by way of results from research carried out whereby further details about structure, work hardening, mechanical properties and magnetic properties will be disclosed in connection with the following Example which is to be considered as illustrative of the present invention. It should be understood, however, that the invention is not limited to the specific details of the Example.

EXAMPLE

Production of the testing materials included melting in a high-frequency induction furnace and casting to ingots at about 1600° C. These ingots were heated to about 1200° C. and hot worked by forging the material into bars. The materials were then subjected to hot rolling into strips which thereafter were quench annealed and clean pickled. The quench anneal was carried out at about 1080° C. and quenching occurred in water.

The strips obtained after quench annealing were then cold rolled to various amounts of reduction after which test samples were taken out for various tests. In order to avoid variations in temperature and their possible impact on magnetic properties, the samples were cooled to room temperature after each cold rolling step.

The chemical analysis of the testing materials in weight-% appear from Table 1 below:

TABLE 1

| Steel No. | C | Si | Mn | Cr | Ni | Mo | Al | N |
|---|---|---|---|---|---|---|---|---|
| | Chemical analysis, in weight %, of test material. | | | | | | | |
| 867* | .088 | 3.6 | 5.34 | 18.09 | 8.92 | | | 0.18 |
| 881* | .051 | 3.7 | 3.87 | 20.41 | 9.83 | | | 0.25 |
| 872** | .066 | 3.8 | 1.53 | 16.77 | 13.1 | | | 0.13 |
| 880** | .052 | .89 | 3.82 | 20.25 | 10.01 | — | — | 0.29 |
| 866** | .11 | .83 | 1.49 | 18.79 | 9.47 | — | — | 0.20 |
| AISI** 304 | .034 | .59 | 1.35 | 18.56 | 9.50 | — | — | 0.17 |
| AISI** 305 | .042 | .42 | 1.72 | 18.44 | 11.54 | — | — | 0.036 |

P.S < 0.030 weight % is valid for all alloys above.
*alloys of the invention
**comparison samples In the quench annealed condition, samples were taken for control of amounts of ferrite and martensite and for measurement of hardness. The results are disclosed in Table 2.

TABLE 2

Microstructure of test alloys in annealed hot rolled strips.

| Steel No. | Annealing temperature, °C. | ferrite % | martensite % | hardness Hv |
|---|---|---|---|---|
| 867* | 1080 | 0 | 0 | 183 |
| 881* | " | 0 | 0 | 205 |
| 872** | " | 0 | 0 | 215 |
| 880** | " | 0 | 0 | 195 |
| 866** | " | 0 | 0 | 186 |
| AISI 304** | " | 0 | 0 | 174 |
| AISI 305** | " | 0 | 0 | 124 |

*alloys of the invention
**comparison samples

All test alloys fulfill the requirements of being free from ferrite and martensite in the quench annealed condition. The annealed hardness corresponds approximately with that of reference materials AISI 304/305.

As described above, it is very important that materials according to the invention has been subject of substantial word hardening during the cold working steps. Table 3 below shows how increased hardness is obtained with increased amounts of deformation.

TABLE 3

Vickers hardness for test alloys with increased amounts of cold deformation.

| Steel No. | 867 * | 881 * | 872 ** | 880 ** | 866 ** | AISI 304 ** | AISI 305 ** |
|---|---|---|---|---|---|---|---|
| quench-annealed | 183 | 205 | 215 | 195 | 186 | 174 | 124 |
| 35% def | 380 | 380 | 390 | 390 | 375 | 355 | 300 |

TABLE 3-continued

Vickers hardness for test alloys with increased amounts of cold deformation.

| Steel No. | 867 * | 881 * | 872 ** | 880 ** | 866 ** | AISI 304 ** | AISI 305 ** |
|---|---|---|---|---|---|---|---|
| 50% def | 410 | 415 | 425 | 427 | 405 | 385 | 340 |
| 75% def | 450 | 460 | 465 | 448 | 440 | 430 | 385 |

* alloys of the invention
** comparison samples

All testing alloys appear to have been substantially work hardened compared with reference materials AISI 304/305.

The strength of the alloys when subjected to uniaxial tensile testing as a function of the amount of cold working appears from Table 4, where $R_p$ 0.05 and $R_p$ 0.2 correspond to the load that gives 0.05% and 0.2% remaining elongation, where $R_m$ corresponds with the maximum load value in the load-elongation diagram and where A10 corresponds with ultimate elongation.

TABLE 4

Yield point, tensile strength and elongation of test materials.

| Steel No. | Condition | $R_p$0.05 MPa | $R_p$0.2 MPa | Rm MPa | A10 % |
|---|---|---|---|---|---|
| 867* | 35% reduction | 727 | 1002 | 1168 | 8 |
| | 50% reduction | 925 | 1226 | 1407 | 5 |
| | 75% reduction | 976 | 1346 | 1560 | 4 |
| 881* | 35 | 756 | 1038 | 1240 | 8 |
| | 50 | 891 | 1247 | 1482 | 6 |
| | 75 | 997 | 1396 | 1659 | 4 |
| 872** | 35 | 724 | 1009 | 1200 | 8 |
| | 50 | 915 | 1262 | 1465 | 5 |
| | 75 | 1054 | 1431 | 1687 | 4 |
| 880* | 35 | 836 | 1086 | 1208 | 7 |
| | 50 | 1025 | 1288 | 1410 | 5 |
| | 75 | 985 | 1343 | 1566 | 4 |
| 866** | 35 | 796 | 1036 | 1151 | 8 |
| | 50 | 986 | 1239 | 1366 | 5 |
| | 75 | 997 | 1356 | 1558 | 4 |
| AISI** | 35 | 683 | 912 | 1080 | 9 |
| 304 | 50 | 841 | 1127 | 1301 | 6 |
| | 75 | 910 | 1300 | 1526 | 5 |
| AISI** | 35 | 555 | 701 | 791 | 15 |
| 305 | 50 | 841 | 1042 | 1139 | 6 |
| | 75 | 868 | 1177 | 1338 | 5 |

*alloys of the invention
**comparison samples.

Table 4 shows that with alloys of the present invention, very high strength levels can be obtained by cold working. AISI 305 appears to show a substantially slower work hardening probably due to its low contents of dissolved alloys elements, i.e., nitrogen and carbon, combined with a rather high nickel content.

Spring steel type SS 2331 is often annealed in order to obtain a further improvement of its mechanical properties. This annealing positively impacts several important spring properties such as fatigue strength and relaxation resistance and offers the possibility of forming the material in a rather soft condition. The higher ductility at lower strength can hereby be used for a more complicated formation of the material. Table 5 shows the effects of such annealing on mechanical properties after 75% cold reduction.

The annealing tests resulted in optimal effect at a temperature of 450° C. and 2 h maintenance.

TABLE 5

Yield point, tensile strength and elongation after annealing 450° C./2 h at cold working. The figures in parenthesis indicate the change in percentage of strength values when annealed.

| Steel No. | $R_p$0.05 MPa | $R_p$0.2 MPa | Rm MPa | A10 % |
|---|---|---|---|---|
| 867* | 1400 | 1660 | 1822 | 3 |
| | (43) | (23) | (17) | |
| 881* | 1501 | 1770 | 1938 | 2 |
| | (50) | (27) | (18) | |
| 872** | 1415 | 1752 | 1958 | 2 |
| | (34) | (22) | (16) | |
| 880** | 1368 | 1598 | 1740 | 3 |
| | (38) | (19) | (11) | |
| 866** | 1305 | 1565 | 1720 | 3 |
| | (30) | (15) | (10) | |
| AISI** | 1189 | 1470 | 1644 | 3 |
| 304 | (30) | (13) | (07) | |
| AISI** | 1057 | 1260 | 1380 | 4 |
| 305 | (21) | (07) | (03) | |

*alloys of the invention
**comparison samples

The alloys of the present invention have a very good effect after annealing. It is of specific importance to have achieved such a substantial increase in $R_p$ 0.05 (>40%). This is the value that is best correlated with the elastic limit which is an indication how much a spring can carry a load without plastification. Due to the increased value in $R_p$ 0.05, a larger application area for a spring is achieved. It is specifically interesting to notice that there is a modest increase in tensile strength in the materials AISI 304 and AISI 305. This is an important disadvantage since the tensile strength by experience is the value that is best correlated to the fatigue strength.

For a material according to this invention there is the requirement that this material, while exhibiting high strength, also has as low magnetic permeability as possible, i.e., close to 1.

Table 6 shows the magnetic permeability depending upon field strength for the various alloys after 75% cold reduction and annealing at 450° C./2 h.

TABLE 6

Permeability values of test alloys. Underlined values indicate maximal measured permeability. The value at the bottom indicates tensile strength in corresponding condition.

| Field strength | Steel No. | | | | | | |
|---|---|---|---|---|---|---|---|
| Oersted | 867* | 881* | 872** | 880** | 866** | AISI 304** | AISI 305** |
| 25 | 1.0350 | 1.0437 | — | — | — | — | — |
| 50 | 1.0389 | 1.0497 | 1.1271 | 1.0099 | 1.0346 | 1.5231 | 1.0593 |
| 100 | 1.0372 | 1.0486 | 1.1544 | 1.0118 | 1.0248 | 1.8930 | 1.0666 |
| 150 | 1.0359 | 1.0461 | 1.1433 | 1.0115 | 1.0413 | 2.1056 | 1.0688 |
| 200 | 1.0350 | 1.0448 | 1.1407 | 1.0110 | 1.0505 | 2.2136 | 1.0729 |
| 300 | 1.0329 | 1.0424 | 1.1433 | 1.0099 | 1.0640 | 2.2258 | 1.0803 |
| 400 | 1.0322 | 1.0418 | 1.1513 | 1.0089 | 1.0754 | 2.1506 | 1.0855 |
| 500 | 1.0321 | 1.0415 | 1.1526 | 1.0081 | 1.0843 | 2.0601 | 1.0884 |
| 700 | — | 1.0406 | 1.1518 | 1.0071 | 1.0917 | — | 1.0859 |
| 1000 | — | — | — | — | 1.0882 | — | — |

TABLE 6-continued

Permeability values of test alloys. Underlined values indicate maximal measured permeability. The value at the bottom indicates tensile strength in corresponding condition.

| Field strength | Steel No. | | | | | | |
|---|---|---|---|---|---|---|---|
| Oersted | 867* | 881* | 872** | 880** | 866** | AISI 304** | AISI 305** |
| Rm MPa | 1822 | 1938 | 1958 | 1740 | 1734 | 1644 | 1380 |

*alloys of the invention
**comparison samples.

Table 6 shows that with alloys of this invention it is possible, by coldworking and precipitation hardening, to achieve a strength exceeding 1800 or even 1900 MPa combined with very low values of the magnetic permeability of $<1.05$. The reference alloys with compositions outside the scope of this invention and the reference steels AISI 304 and AISI 305 appear to be too unstable in austenite, alloys 866, 872 and AISI 304 appear to be non-magnetic at high strength or appear to have an insufficient degree of work hardening, and alloy AISI 305 appears to have sufficient mechanical strength that is representative for a good spring material.

The effect of silicon as a precipitation hardening element is apparent from alloys 880 and 881 which, except Si, have a corresponding composition. The latter alloy has a high Si content and appears to have, at same reduction degree and heat treatment, about 200 $N/mm^2$ higher tensile strength than compared with alloy 880 which has a lower Si content.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

WHAT IS CLAIMED IS:

1. Non-magnetic, stainless steel alloy having high strength, consisting essentially of, in percent by weight:
C: 0.04–0.25%
Si: 2.0–5.0%
Mn: 3.5–7.5%
Cr: 16–21%
Ni: 8–11%
N: 0.10–0.45%
the remainder being iron and normal impurities, the contents of said elements being balanced so that the austenite phase remains stable against deformation into martensite during cold working.

2. The steel alloy of claim 1, wherein the elements are balanced that the austenite phase remains sufficiently stable so as to resist any transformation into martensite at cold working $>70\%$ thickness reduction.

3. The steel alloy of claim 1, wherein the Cr-content is 16–19%.

4. The steel alloy of claim 1, wherein the Ni-content is 8–10%.

5. The steel alloy of claim 1, wherein the C-content is 0.04–0.15%.

6. The steel alloy of claim 1, wherein the Si-content is 3.0–5.0%.

7. The steel alloy of claim 1, wherein the N-content is 0.15–0.45%.

8. The steel alloy of claim 1, wherein the Mn-content is 3.5–5.5%.

* * * * *